US005961436A

United States Patent [19]

Ding

[11] Patent Number: 5,961,436

[45] Date of Patent: Oct. 5, 1999

[54] ENVELOPE WITH OPENING DEVICE

[76] Inventor: Younian Ding, 143-50 Ash Ave. 2nd Fl., Flushing, N.Y. 11355

[21] Appl. No.: 09/063,851

[22] Filed: Apr. 21, 1998

[51] Int. Cl.[6] ..... B65D 27/38

[52] U.S. Cl. ..... 493/923; 493/212; 493/963; 229/311; 229/312

[58] Field of Search ..... 493/212, 923, 493/963; 229/309, 310, 311, 312

[56] References Cited

U.S. PATENT DOCUMENTS

| | | | |
|---|---|---|---|
| 3,655,120 | 4/1972 | Stern | 229/86 |
| 5,045,040 | 9/1991 | Vetter | 493/194 |
| 5,505,376 | 4/1996 | Kent et al. | 229/311 |
| 5,752,652 | 5/1998 | Castro | 229/312 |
| 5,799,865 | 9/1998 | Gray | 229/309 |

*Primary Examiner*—Joseph J. Hail, III
*Assistant Examiner*—William Hong
*Attorney, Agent, or Firm*—Chen, Lin, Li and Jiang JJP

[57] ABSTRACT

An envelope formed from a single sheet of paper includes a front portion, a top flap, two lateral side flaps, a bottom flap, a top folding edge, two lateral side folding edges, and a bottom folding edge, the lateral side flaps overlapping and adhering to the bottom flap to form the back portion of the envelope. The top flap will adhere to the back portion after contents of interest are inserted into the envelope. The envelope further includes an opening device in the form of a piece of thin line disposed inside the envelope. The thin line loosely extends along one of the folding edges with its first end attached to one spot near one end of that folding edge and its opposite second end attached to an anchor portion on the outermost flap near the other end of that folding edge. The anchor portion does not adhere to any other flap.

5 Claims, 6 Drawing Sheets

ENVELOPE WITH OPENING DEVICE

BACKGROUND OF THE INVENTION

1. Field of the Intention

The present invention relates generally to an envelope. More particularly, the present invention relates to an envelope with an opening device.

2. Description of the Prior Art

Conventional prior art envelopes formed from a single sheet of paper have been used for many years. While conventional envelopes have operated with a high degree of success, they are not perfect. One major deficiency associated with the conventional envelopes is that they do not have any integral opening devices by which receivers can easily open the envelopes. Normally a receiver can open a conventional envelope by tearing off one of its lateral ends by hands. The resulting opening, however, is not neat or clear cut. Furthermore, the contents of interest placed inside the envelope may be inadvertently damaged during the opening process. It is known that sometimes letters or documents inside envelopes are torn apart.

A receiver can also open a conventional envelope by using conventional opening instruments such as envelope openers or scissors. Again, the contents of interest placed inside the envelope may be inadvertently damaged during the opening process if the receiver is not careful enough even though the resulting opening is much neater. In addition, an envelope opener sometimes is useless if an envelope is completely sealed. Furthermore, envelope openers and scissors, which are usually made of metals and quite heavy, are hazardous to small children.

Therefore, it has been known that it would be desirable to have a novel envelope which has an integral opening device, which is lightweight and inexpensive to manufacture and purchase, which is characterized by ease of utilization and simplicity of construction, which is highly efficient in operation, and which further reduces to an absolute minimum the assorted deficiencies associated with the conventional envelopes and envelope opening instruments.

SUMMARY OF THE INVENTION

Therefore, it is an object of the present invention to provide a novel envelope.

Another object of the present invention is to provide an envelope having an opening device.

Another object of the present invention is to provide an envelope having an integral opening device so that a receiver can use that device to easily open the envelope without damaging the contents of interest placed inside the envelope.

Another object of the present invention is to provide an envelope with an opening device so that a receiver can easily open the envelope without using any conventional opening instruments such as envelope openers or scissors and without damaging the contents of interest placed inside the envelope, the resulting opening being relatively neat and clear cut.

Another object of the present invention is to provide an envelope having an opening device; the device adds little weight to the envelope.

Another object of the present invention is to provide an envelope having an opening device; the device, before its usage, would not weaken the structure strength of the envelope.

Another object of the present invention is to provide an envelope having an opening device, which is relatively inexpensive to manufacture and purchase.

Yet another object of the present invention is to provide an envelope having an opening device, which is characterized by ease of utilization and simplicity of construction.

Still another object of the present invention is to provide an envelope having an opening device, which is operable to obtain the individual benefits and advantages to be derived from the related prior art envelopes and envelope opening instruments while avoiding the assorted detriments individually associated therewith.

Further objects and advantages are to provide novel and improved elements and arrangements thereof in an envelope for the purposes described, and which is dependable, economical, durable, and fully effective in accomplishing its intended purposes.

These and other objects and advantages are achieved in a novel envelope which includes a main body including a front portion, a top flap, two lateral side flaps, a bottom flap, a top folding edge, two lateral side folding edges, and a bottom folding edge, the lateral side flaps overlapping and adhering to the bottom flap to form the back portion of the envelope, and wherein the top flap will adhere to the back portion after contents of interest are inserted into the envelope; and a piece of thin line disposed inside the envelope and loosely extending along one of the folding edges with its first end attached to a spot near one end of that folding edge and its second end attached to an anchor portion on the outermost flap near the other end of that folding edge, and wherein the anchoring portion does not adhere to any other flap.

These and other objects and advantages of the present invention will become more apparent from the following detailed description of the preferred embodiments of the invention taken in combination with the accompanying drawings and the attached claims.

DESCRIPTION OF THE PREFERRED EMBODIMENT

First Embodiment

Figure 1:
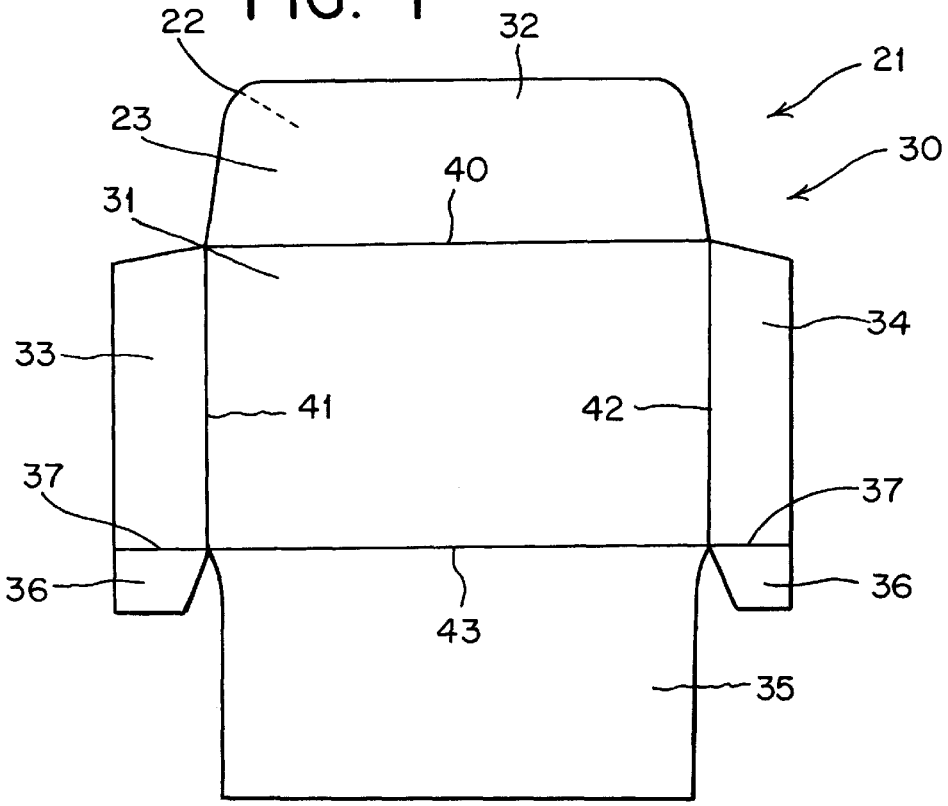
FIG. 1 is a plan view of a single preformed sheet from which the first embodiment of the envelope of the present invention may be formed.
Figure 5:
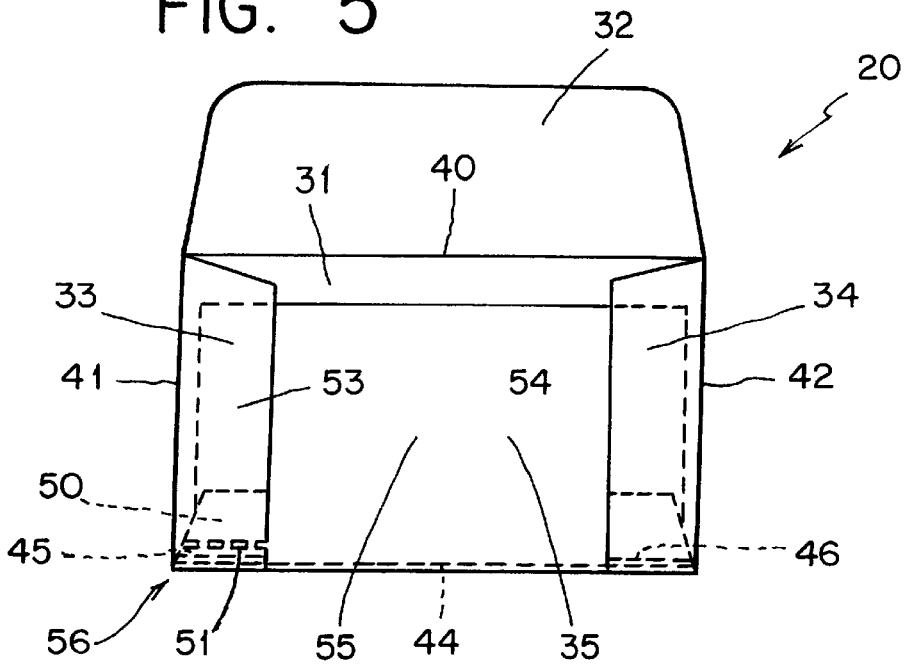
FIG. 5 is a rear view of the first embodiment of the envelope in its finished form.

Referring more particularly to the drawings, the first embodiment of the envelope of the present invention is generally indicated by the numeral 20 in FIG. 5. The envelope 20 is formed from a single preformed flexible sheet 21, illustratively of paper. As best shown in FIG. 1, the flexible sheet 21 has a front surface 22 and an opposite back surface 23. The flexible sheet 21 further has a main body 30 which includes a generally rectangular-shaped front portion 31; a generally trapezoid-shaped or ladder-shaped top flap 32 extending from the top of the front portion 31; two generally elongated lateral side flaps 33 and 34 extending from the lateral sides of the front portion 31, respectively; and a generally rectangular-shaped bottom flap 35 extending from the bottom of the front portion 31. The top flap 32, the lateral side flaps 33 and 34 and the bottom flap 35 are separated from the front portion 31 by a top folding edge 40, two lateral side folding edges 41 and 42 and a bottom folding edge 43, respectively. Furthermore, each of the lateral side flaps 33 and 34 includes a tab 36 extending from its bottom edge 37. The function of those tabs 36 will be discussed below.

Figure 2:
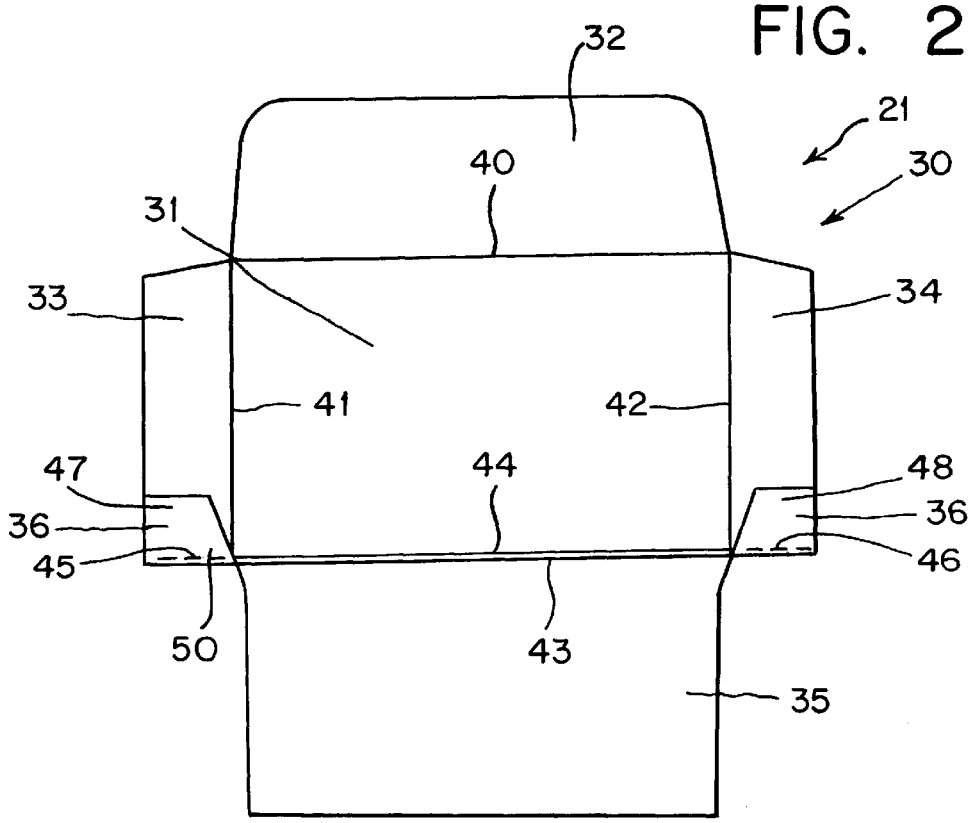
FIG. 2 through FIG. 4 illustrate how the first embodiment of the envelope is formed.

The envelope 20 further includes an opening device 44 in the form of a piece of thin line such as a thin thread or a thin wire, which is disposed inside the envelope 20. As best shown in FIG. 2, the thin line 44 loosely extends along the bottom folding edge 43 with its first end 45 disposed between the lateral side flap 33 and its tab 36 and its opposite second end 46 disposed between the lateral side flap 34 and its tab 36. Each tab 36 is then folded backward or upward along the bottom edge 37, and completely adheres to the respective lateral side flap by means of an adhesive and the like to form a seam 47 or 48. As a result, the first and second ends 45 and 46 of the thin line 44 are firmly attached to or secured by the seams 47 and 48, respectively. The lower or outer portion of the seam 47, which contains the first end 45, functions as an anchor portion 50. The function of the anchor portion 50 will be discussed below.

Figure 3:
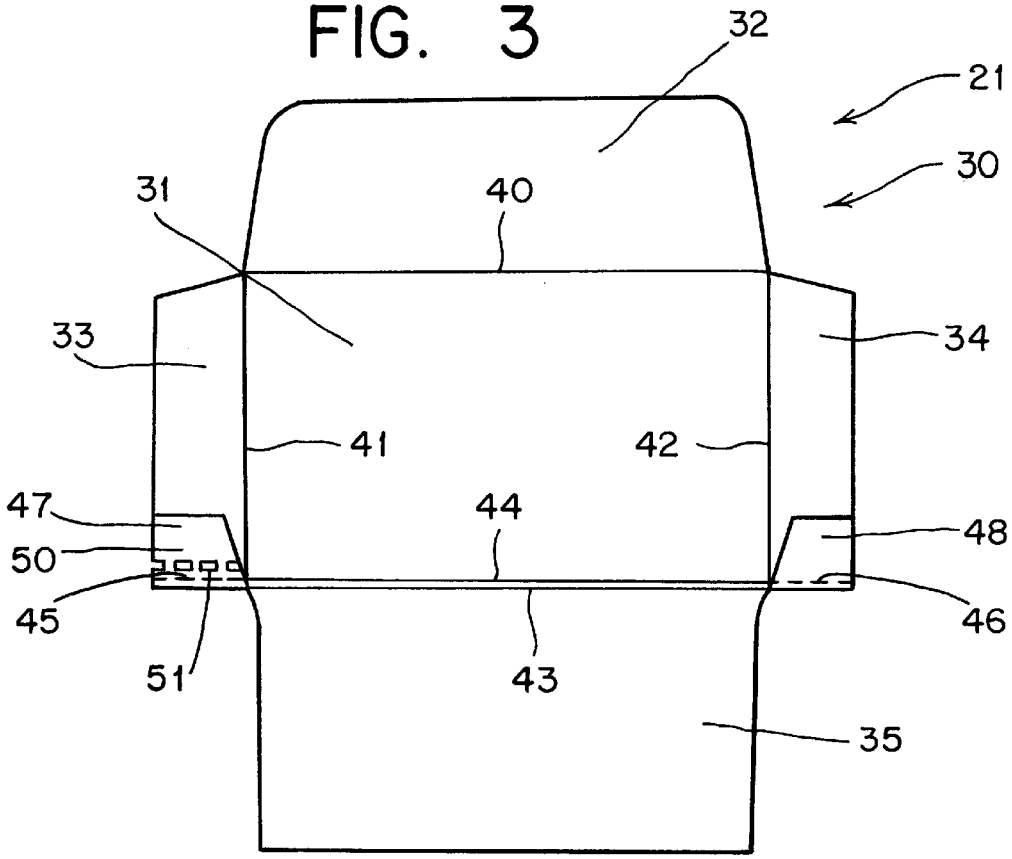

As best illustrated in FIG. 3. a line or a series of perforations 51 is provided on the anchor portion 50 to function as an easy-tearing device. The line of perforations 51 is parallel to the first end 45 of the thin line 44 and extends inward from the lateral side edge of the seam 47 at a location slightly above the first end 45. As should be understood, the line of perforations 51 could be replaced by a notch, a slit, a line of cuts or a line of any shaped apertures to achieve the same purpose.

Figure 4:
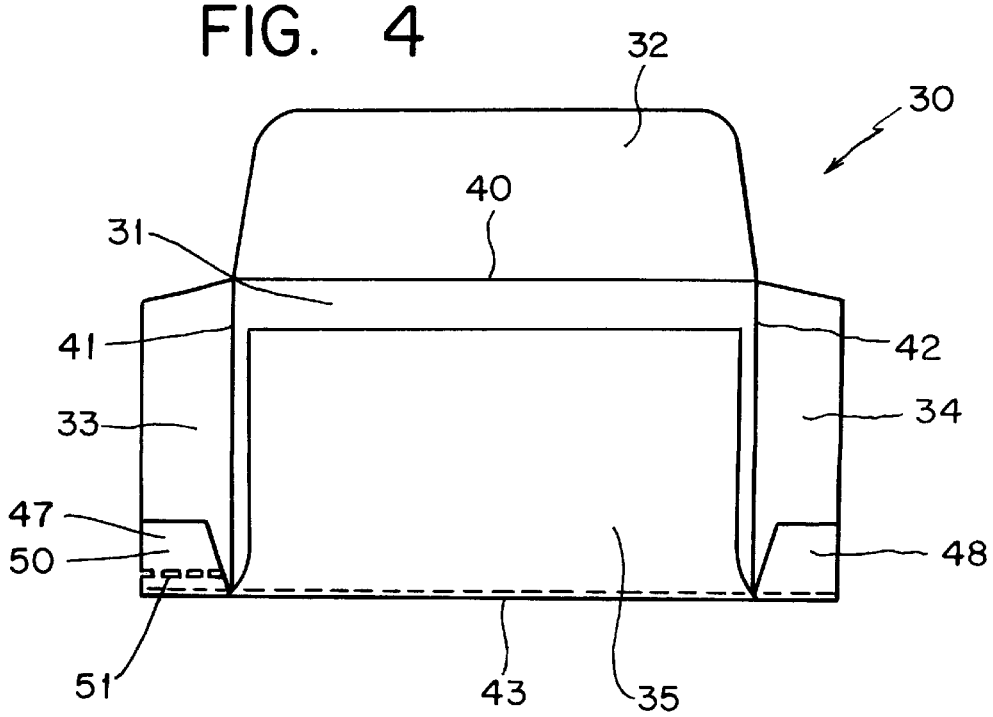

As best shown in FIG. 4, the bottom flap 35 is then folded backward or upward along the bottom folding edge 43. The lateral side flaps 33 and 34 are then folded backward along the lateral side folding edges 41 and 42, respectively. As best shown in FIG. 5, both of the lateral side flaps 33 and 34 overlap and adhere to the bottom flap 35 by means of an adhesive and the like along seams 53 and 54, respectively, to form the back portion 55 of the envelope 20. As should be understood, the anchor portion 50, or at least the portion below the line of perforations 51, does not adhere to the bottom flap 35. Moreover, the lateral side flap 33 bearing the anchor portion 50 should always be the outermost flap on the left bottom corner 56 of the envelope 20. The top flap 32 will be folded backward or downward along the top folding edge 40 and then sealed or adhere to the back portion 55 after contents of interest such as letters or documents are insert into the envelope 20.

As should be understood and as illustrated by the other embodiments discussed below, the shape of each flap may vary. The tabs 36 may be borne by any single flap or any two neighboring flaps, and their shape and size may vary. Moreover, the tabs 36 may be replaced by any other conventional securing means such as adhesives. The thin line 44 may be disposed inside the envelope 20 and loosely (not adhere to) extend along any one of the four folding edges as long as its first end 45 is attached to a spot near one end of that folding edge and its second end 46 attached to an anchor portion on the outermost flap near the other end of that folding edge. Of course, the anchor portion does not adhere to any other flap.

Second Embodiment

Figure 6:
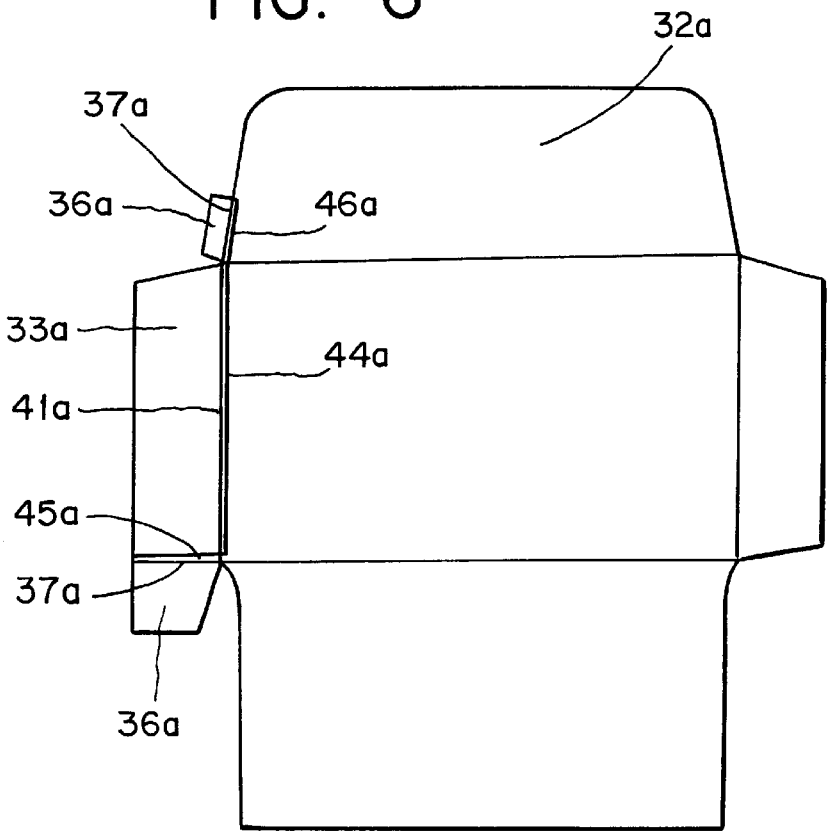
FIG. 6 is a plan view of a single preformed sheet with a pre-positioned thin line from which the second embodiment of the envelope of the present invention may be formed.
Figure 7:
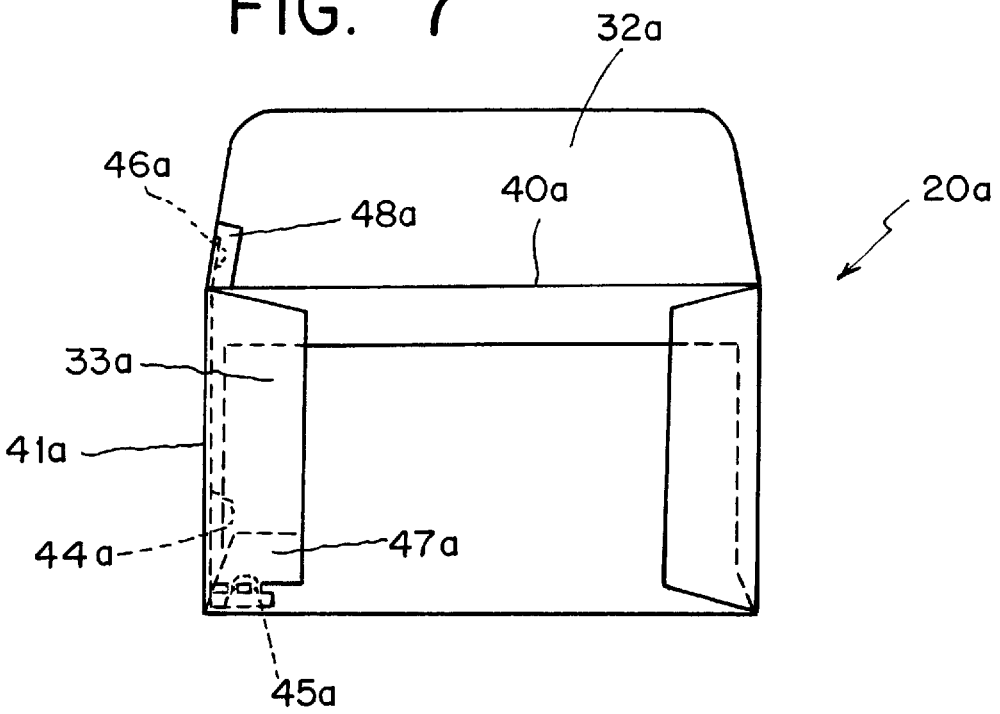
FIG. 7 is a rear view of the second embodiment of the envelope in its finished form.

The second embodiment of the envelope of the present invention is generally indicated by the numeral 20*a* in FIG. 7. As best shown in FIG. 6 and FIG. 7, the envelope 20*a* is identical to the first embodiment 20 except that its thin line 44*a* loosely extends along the lateral side folding edge 41*a* with its second end 46*a* attached to or secured by a smaller seam 48*a* formed on the top flap 32*a*. Like the first embodiment 20, the first end 45*a* of the thin line 44*a* is secured by a seam 47*a* formed on the lateral side flap 33*a*. As best shown in FIG. 7, before adhering to the top flap 32*a* to form the seam 48*a*, the upper tab 36*a* extends from the left side edge of the top flap 32*a* and is disposed adjacent to the top folding edge 40*a*.

Third Embodiment

Figure 8:
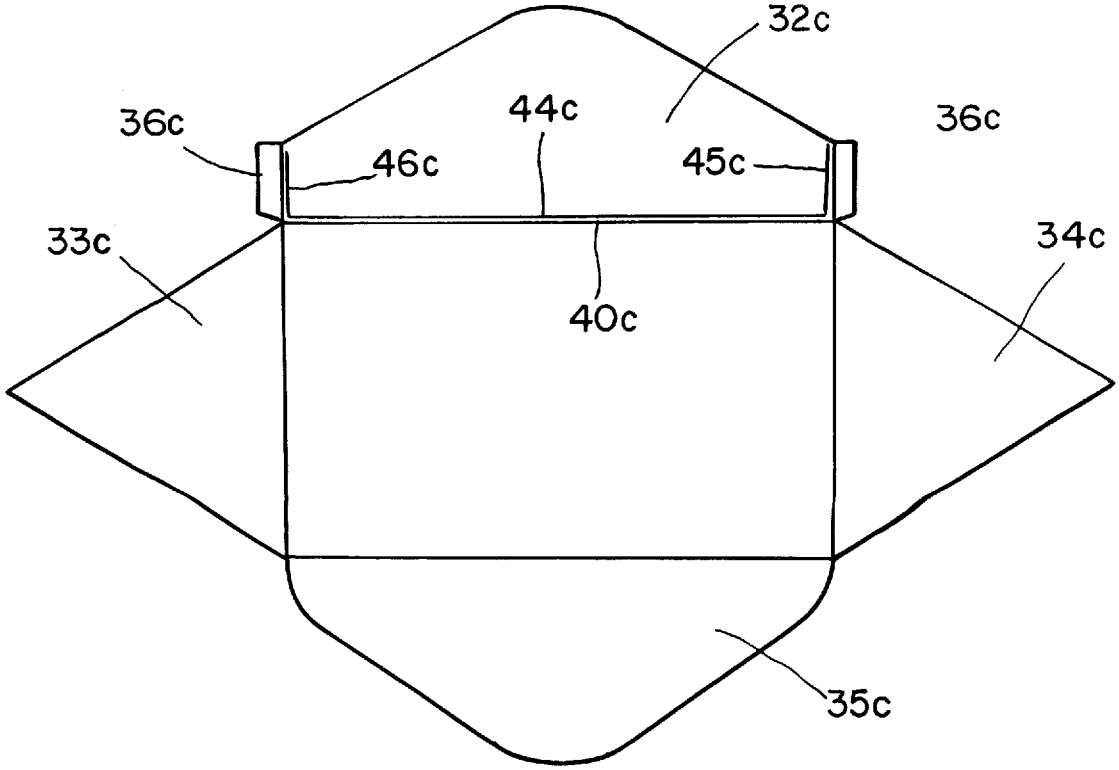
FIG. 8 is a plan view of a single preformed sheet with a pre-positioned thin line from which the third embodiment of the envelope of the present invention may be formed.
Figure 9:
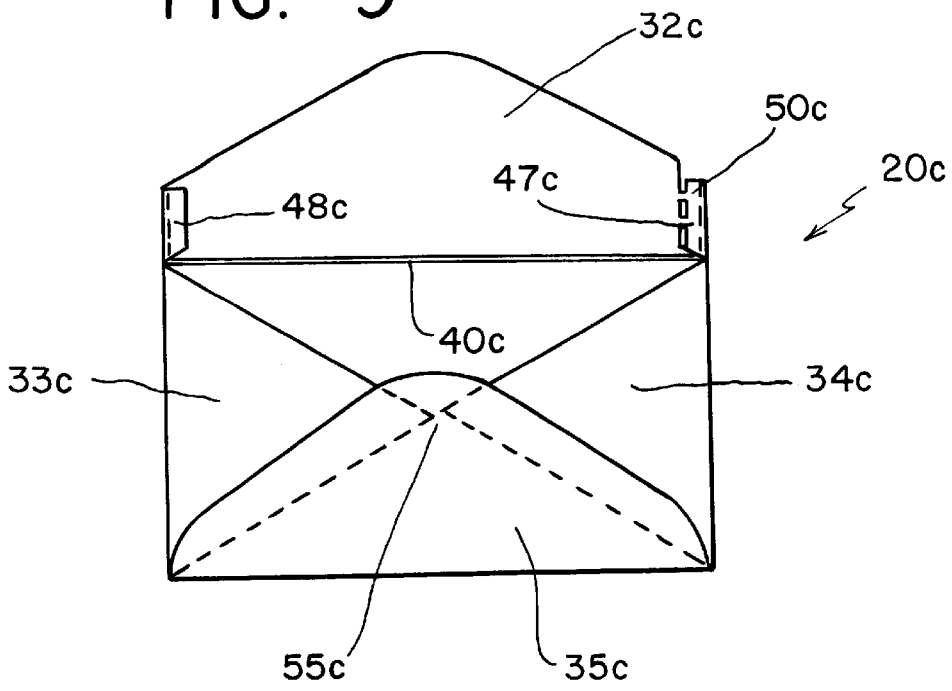
FIG. 9 is a rear view of the third embodiment of the envelope in its finished form.

The third embodiment of the envelope of the present invention is generally indicated by the numeral 20*c* in FIG. 8 and FIG. 9. Like the second embodiment 20*a*, the third embodiment 20*c* is substantially similar to the first embodiment 20. The difference is that the top flap 32*c*, the two lateral side flaps 33*c* and 34*c* and the bottom flap 35*c* are each generally triangularly shaped. Moreover, both of the tabs 36*c* are borne by the top flap 32*c*. The thin line 44*c* loosely extends along the top folding edge 40*c* with its first and second end 45*c* and 46*c* secured by seams 47*c* and 48*c*, respectively. As should be understood, when the top flap 32*c* adheres to the back portion 55*c* after contents of interest are inserted into the envelope, the anchor portion 50*c* does not adhere to the lateral side flap 34*c*.

Fourth Embodiment

Figure 10:
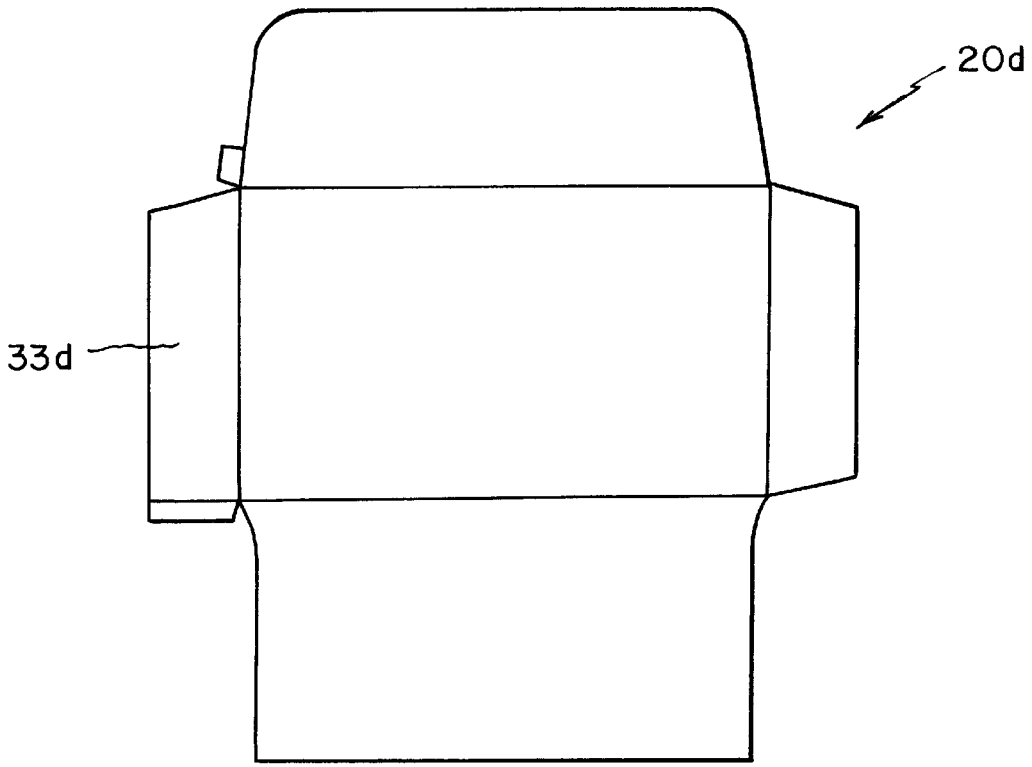
FIG. 10 is a plan view of a single preformed sheet from which the fourth embodiment of the envelope of the present invention may be formed.
Figure 11:
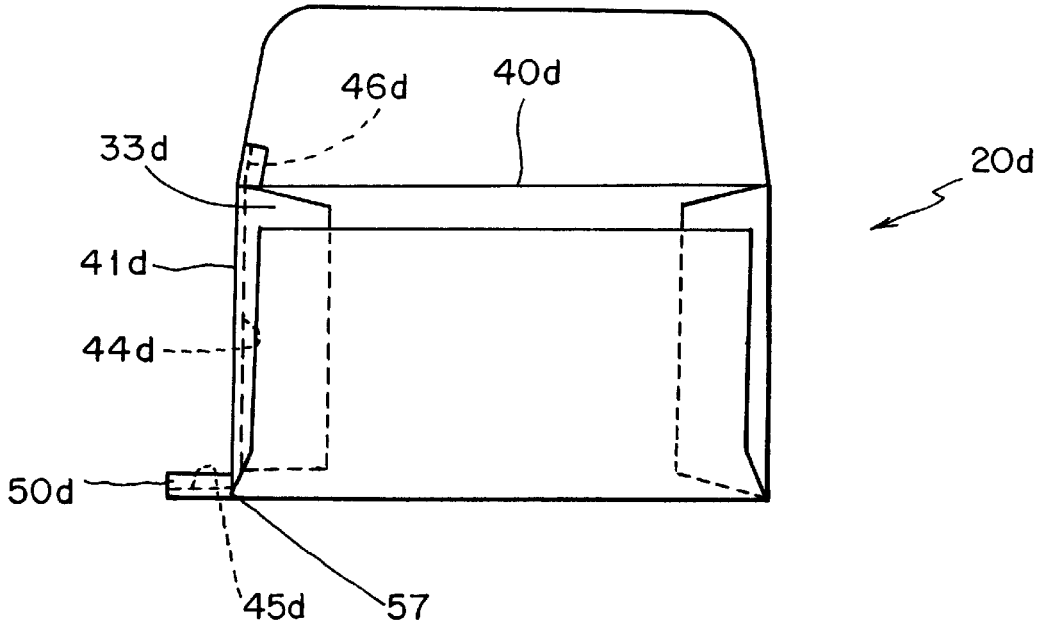
FIG. 11 is a rear view of the fourth embodiment of the envelope in its finished form.

The fourth embodiment of the envelope of the present invention is generally indicated by the numeral 20*d* in FIG. 10 and FIG. 11. The fourth embodiment 20*d* is identical to the second embodiment 20*a* except that the easy-tearing device is a deep cut or a slit instead of a line of perforations so that the anchor portion 50*d*, which is shaped like a tab, is separated from the lateral side flap 33*d*. In this case, the first end 45*d* of the thin line 44*d* is disposed outside the envelope 20*d* through the bottom end 57 of the lateral side flap 41*d* and the anchor portion 50*d* functions more like an attachment. Furthermore, the side flap 33*d* does not have to be the outermost flap on the left bottom corner of the envelope. As should be understood, the attachment could be any shaped object such as a ball so long as it is large enough to prevent the first end 45*d* from slipping into the envelope 20*d*.

Fifth Embodiment

Figure 12:
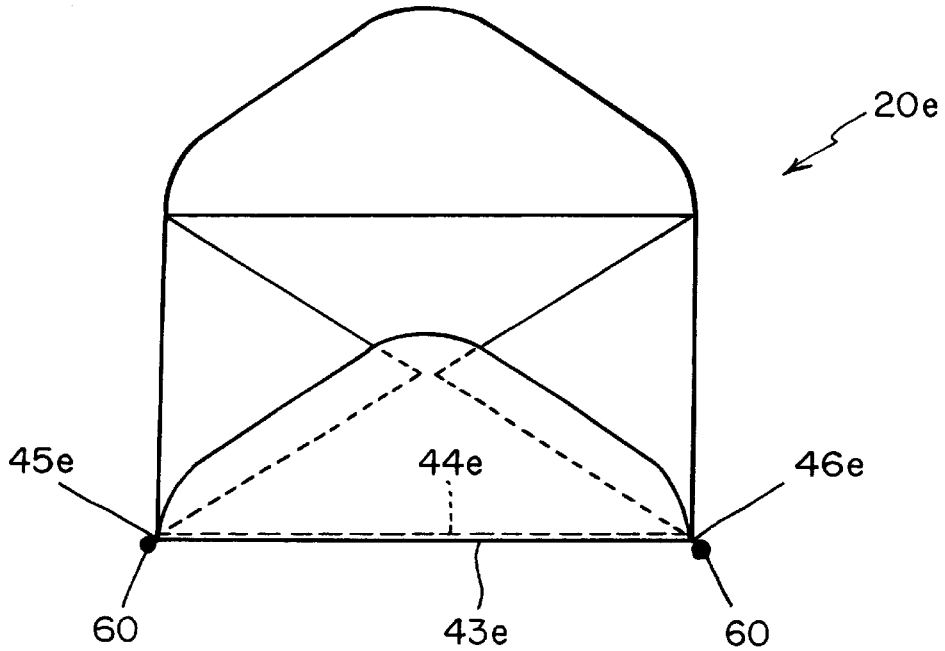
FIG. 12 is a rear view of the fifth embodiment of the envelope of the present invention in its finished form.

The fifth embodiment of the envelope of the present invention is generally indicated by the numeral 20*e* in FIG. 12. The fifth embodiment 20*e* is identical to the third embodiment 20*c* except that the thin line 44*e*, which is disposed inside the envelope, loosely extends along the bottom folding edge 43*e* with its first and second ends 45*e* and 46*e* disposed outside the envelope through the two opposite ends of the bottom folding edge 44*e*. Furthermore, unlike the third embodiment 20*c* which uses two tabs 47*c* and 48*c* to secure the first and second ends of the thin line 44*c*. An attachment 60 such as a small ball or a small ball-shaped object is affixed to the first and second ends 45*e* and 46*e* to prevent them from accidentally slipping into the envelope 20*e*. As should be understood, each attachment 60 could be any shaped object such as a tab or a triangular so long as it is large enough to prevent the first or second end from slipping into the envelope.

OPERATION

The operation of the various embodiments of the present invention is believed to be readily apparent, and therefore is briefly summarized at this point by referring to the operation of the first embodiment 20 only.

In operation, a receiver (not shown) of a sealed envelope 20 first tears the anchor portion 50 from the lateral side flap 33 along the line of perforations 51. The receiver then firmly holds the first end 45 of the thin line 44 by griping the anchor portion 50, and pulls it outwardly against the bottom folding edge 43. Since it is very thin, the line 44 acts like a sharp knife and would easily cut the envelope 20 open along its bottom folding edge 43. The resulting opening is very neat or clear cut. The receiver can then take out the contents of interest placed inside the envelope 20.

Although the present invention has been herein shown and described in what is conceived to be the most practical and preferred embodiments, it is recognized that departures may be made therefrom within the scope of the present invention which is not to be limited to the illustrative details disclosed above.

Having described my invention, what I claim as new and desire to secure by Letters Patent is:

1. An envelope comprising:

a main body formed from a single flexible sheet of paper and including a generally rectangular-shaped front portion, a top flap extending from the top of the front portion and folded backward along a top folding edge, two lateral side flaps extending from the lateral sides of the front portion and folded backward along two lateral side folding edges, respectively, and a bottom flap extending from the bottom of the front portion and folded backward along a bottom folding edge, the lateral side flaps overlapping and adhering to the bottom flap to form the back portion of the envelope, and wherein the top flap will adhere to the back portion after contents of interest are inserted into the envelope; and a piece of thin line having opposite first and second ends, the thin line being disposed inside the envelope and loosely extending along one of the folding edges with its first end attached to one end of the folding edge and its second end attached to an anchor portion on an outermost flap near the other end of the folding edge, the outermost flap having a tab which adheres thereto to form the anchor portion, the second end of the thin line being disposed between the tab and the outermost flap and wherein the anchor portion does not adhere to any other flap and includes an easy-tearing device so that a receiver can easily tear the anchor portion from the outermost flap.

2. An envelope as claimed in claim 1, wherein the easy-tearing device is a line of perforations extending inward from a side edge of the outermost flap.

3. An envelope as claimed in claim 1, wherein the easy-tearing device is a line of cuts extending inward from a side edge of the outermost flap.

4. An envelope as claimed in claim 1, wherein the easy-tearing device is a notch on a side edge of the outermost flap.

5. An envelope as claimed in claim 1, wherein the easy-tearing device is a slit extending inward from a side edge of the outermost flap.

* * * * *